US005445417A

United States Patent [19]

Bromer et al.

[11] Patent Number: 5,445,417

[45] Date of Patent: Aug. 29, 1995

[54] PRESENTATION FOLDER AND METHOD OF MAKING

[75] Inventors: Carl B. Bromer, Dayton; David B. Schindler, Kettering, both of Ohio

[73] Assignee: Eskco, Inc., Dayton, Ohio

[21] Appl. No.: 239,289

[22] Filed: May 6, 1994

Related U.S. Application Data

[63] Continuation of Ser. No. 90,235, Jul. 12, 1993, abandoned.

[51] Int. Cl.[6] ..... B42F 7/06; B42D 3/12; B42C 7/00

[52] U.S. Cl. ..... 281/46; 281/31; 281/35; 40/359; 283/109; 283/111; 412/3

[58] Field of Search ..... 281/31, 35, 44–49; 40/359; 283/109, 111; 402/74, 80 P; 412/3, 17

[56] References Cited

U.S. PATENT DOCUMENTS

| | | | |
|---|---|---|---|
| 3,092,400 | 6/1963 | Smith | 281/31 X |
| 3,206,225 | 9/1965 | Oleson | 281/35 X |
| 3,252,462 | 5/1966 | Quarton et al. | 281/49 X |
| 3,734,155 | 5/1973 | Stenger | 281/46 X |
| 3,870,223 | 3/1975 | Wyart | 281/31 X |
| 4,477,013 | 10/1984 | Herrin | 40/359 X |
| 4,600,346 | 7/1986 | Podosek | 412/3 |
| 4,629,349 | 12/1986 | Pitts | 402/74 |
| 4,886,299 | 12/1989 | Ducorday | 281/31 |
| 4,890,728 | 1/1990 | Grimsley | 281/31 X |
| 4,962,951 | 10/1990 | Mechesney | 281/31 X |
| 5,059,052 | 10/1991 | Caspar | 402/80 R |
| 5,090,732 | 2/1992 | Kuhns et al. | 283/109 X |
| 5,178,414 | 1/1993 | Small et al. | 281/35 |
| 5,181,742 | 1/1993 | Peng | 281/45 |

FOREIGN PATENT DOCUMENTS

| | | | |
|---|---|---|---|
| 1279118 | 11/1961 | France | 281/31 |
| 2639747 | 6/1990 | France | 281/31 |
| 2713880 | 7/1978 | Germany | 281/35 |

*Primary Examiner*—Peter Vo
*Attorney, Agent, or Firm*—Reuben Wolk

[57] ABSTRACT

A presentation folder having a plastic cover sheet or front and back cover sheets joined at a common edge, capable of holding and protecting contents such as papers having information thereon. The cover sheet has pre-applied graphics forming selected opaque display areas, the remaining areas being transparent or translucent and thus capable of revealing at least some of the information on said papers.

20 Claims, 2 Drawing Sheets

PRESENTATION FOLDER AND METHOD OF MAKING

This is a continuation of application Ser. No. 08/090,235, filed Jul. 12, 1993, now abandoned.

BACKGROUND OF THE INVENTION

This invention relates to a presentation folder or report cover, having at least one cover sheet which holds and protects papers having information thereon. The folder provides a high quality lock cover sheet which has pre-applied graphics creating selected opaque areas to display certain data, but also having transparent or translucent areas through which information on the papers is revealed.

PRIOR ART STATEMENT

It is conventional to use transparent cover sheets as report covers, book covers, notebook covers, document holders, and similar products. These usually consist of at least one outside layer of a plastic material that may be heat sealed or otherwise formed into the final product. Such sheets are used to display a name, a company logotype, or other information which has been plated on a sheet of paper such as by printing, and the information is revealed through the transparent cover sheet. Typical patents which illustrate the use of transparent covers are Pitts U.S. Pat. No. 4,529,349; Ducorday U.S. Pat. No. 4,886,299; Casper U.S. Pat. No. 5,059,052; and Small et al U.S. Pat. No. 5,178,414.

SUMMARY OF THE INVENTION

The novel presentation folder which may also be used as a report cover, a notebook cover or a page protector, is used to cover and retain an insert containing information. This arrangement represents a vast improvement over the prior art by creating a high quality look cover which is essentially transparent or translucent, in which the graphics are applied to the cover instead of to the insert. The graphics, which are opaque, are applied by printing, silk screening, hot stamping, appliquéing, or other methods known in the field of graphics. This provides exceptional versatility because the graphics can be a designation such as a name or a company logotype, or a special design pattern; while at the same time the remainder of the folder or cover sheet is transparent or translucent so that any desired information appearing on the insert is revealed. The final product may be used to create a customized look even though the user only has limited equipment to provide his information in graphic form. For example, if the user only has a printer that prints in black, he can combine his printed information with a folder having colored graphics and thus create a high quality multi-colored look to his assembly.

This combination allows a versatility of design and graphic expression not heretofore known. For example, instead of the company name or logotype appearing on the front cover, this information may be placed on the insert sheet to correlate with covers having various patterns, and the same cover may then be used with a different insert. If desired, a company may use a cover having its personalized graphics, and insert various sheets of information within the cover to reveal different types of information, such as sales figures, flow charts, technical data, advertising copy, or the like. For the first time, graphic artwork in the form of decoration or information is actually part of the cover sheet, allowing a user to customize his presentation. The novel folder lends itself to a variety of uses; for example, it may consist of a single cover sheet having pockets for retaining the insert sheet, or may have front and back cover sheets joined together at one edge or at a foldable common edge to form a book-like folder, or may form the cover or be an insert for a looseleaf binder.

It is a principal object of the invention to provide a presentation folder formed of at least one transparent or translucent plastic cover sheet, having selected pre-applied graphics forming opaque areas.

It is a further object to provide such a folder for retaining and protecting information insert sheets having data which is revealed through the non-graphics applied areas of the cover sheet.

It is another object to apply said graphic areas by various processes known in the art.

It is still another object to form said folder into various arrangements which will best display the information placed thereon.

These and other objects, details and features of the invention will become apparent from the typical embodiments presented in the following description and drawings.

DESCRIPTION OF THE PREFERRED EMBODIMENTS

The presentation folder which is the subject of the present invention is formed of one or more cover sheets made of a flexible transparent or translucent plastic material. The preferred material is polyvinyl chloride, although other materials may be used which are economical and durable, such as polyethylene or polypropylene. As will be described in further detail below, the invention may be in the form of a single sheet having a sealed pocket formed the full length of the sheet and open at the top, side or bottom for insertion of paper, cardboard or plastic sheets, or a pocket formed aproximately half-way up from the bottom of the sheet, also open at the top, or a curved pocket partially attached to one side and open at the other. Sealing may be provided by various systems well known in the art, such as by heat, sonic, ultrasonic, or mechanical methods. Instead of a single sheet, the folder may be formed of front and back covers, joined together as by sealing at a common edge, including at a foldable common side edge. In addition, the folder may be a front or front and back cover of a looseleaf binder.

The graphic artwork which is applied to the sheet or sheets of the folder may be applied to either the inner or outer surface with equal results except for cosmetic appearances. Various well-known processes may be utilized to apply the graphics, such as printing, silk-screening, hot stamping (foil stamping); or by appliqué ing such materials as polyviny chloride or mylar, thus achieving a three-dimensional effect.

Figure 1:
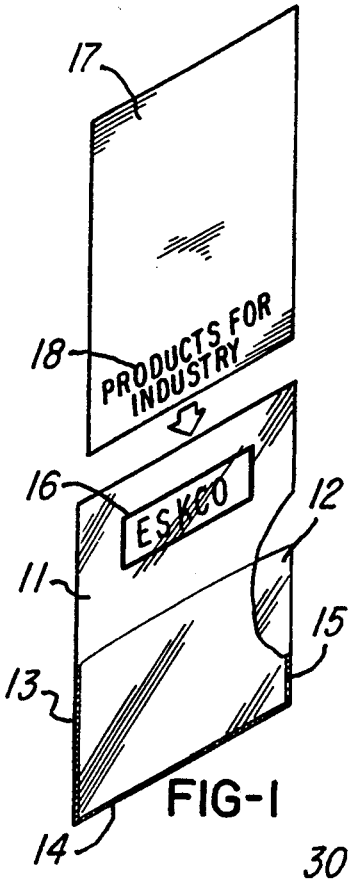
FIG. 1 is an exploded perspective view of one embodiment of the invention, illustrating a novel folder and an insert sheet in unassembled form.
Figure 2:
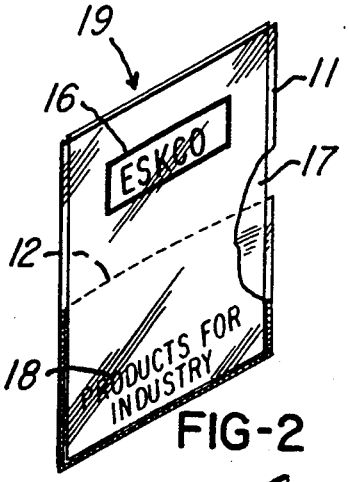
FIG. 2 is a perspective view of the embodiment of FIG. 1 in assembled form.

The various figures are merely intended to be exemplary of the variety of end uses. In FIGS. 1 and 2, the folder consists of a cover sheet 11 having a pocket 12 extending for approximately the lower half of sheet 11, and secured along edges 13, 14 and 15 by using one of the above methods for sealing. On the upper portion of sheet 11 a company name is applied within a block, designated by reference number 16, forming the desired graphic, applied by one of the methods referred to above. As shown in FIG. 1, a typical information sheet 17, bearing desired information 18, is separate and is inserted into the pocket 12 to form a final assembly 19 in which the information 18 is visible through the cover sheet, along with the graphic 16.

Figure 3:
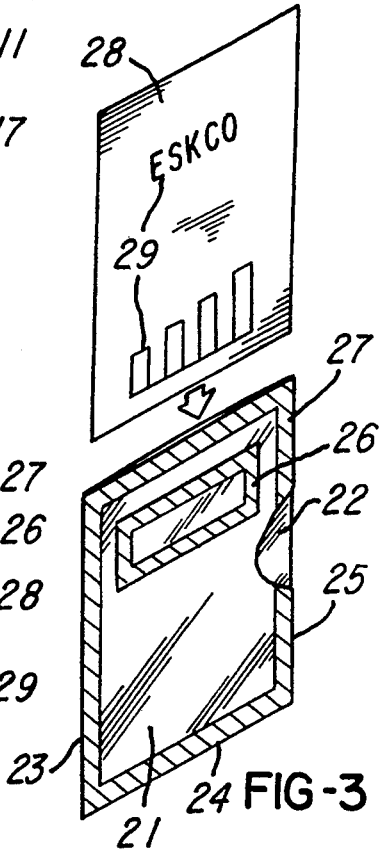
FIG. 3 is an exploded perspective view of another embodiment of the invention, illustrating a different type of folder in unassembled form.
Figure 4:
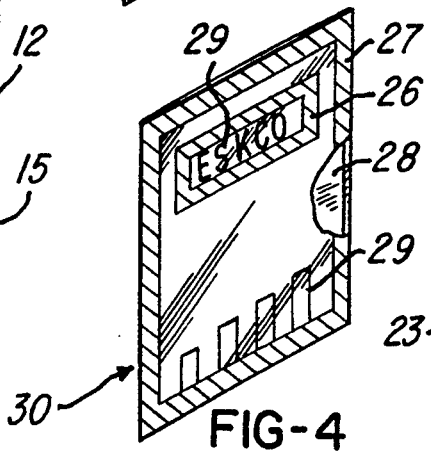
FIG. 4 is a perspective view of the embodiment of FIG. 3 in assembled form.

The versatility of the invention is demonstrated by FIGS. 3 and 4 in which similar results are obtained in a different manner. In this form of the invention, the folder consists of sheet 21 having pocket 22 which in this instance extends for the full length of the sheet 21, the sheet and pocket being sealed along edges 23, 24 and 25. In this embodiment, the graphics on the sheet 21 consist of a rectangular block or box 26 which is any desired color (in this case shown as green), and an edge marking 27, also green. These graphics have been applied by one of the methods described above. Information sheet 28 bears desired information 29, including the company name and other data such as a sales chart. When the sheet 28 is inserted into the pocket 22 to form the assembly 30 of FIG. 4, the company name appears within the block 26 and is visible through the cover sheet, as is the sales chart in the lower area. The final product provides a harmonious and pleasing design.

Figure 5:
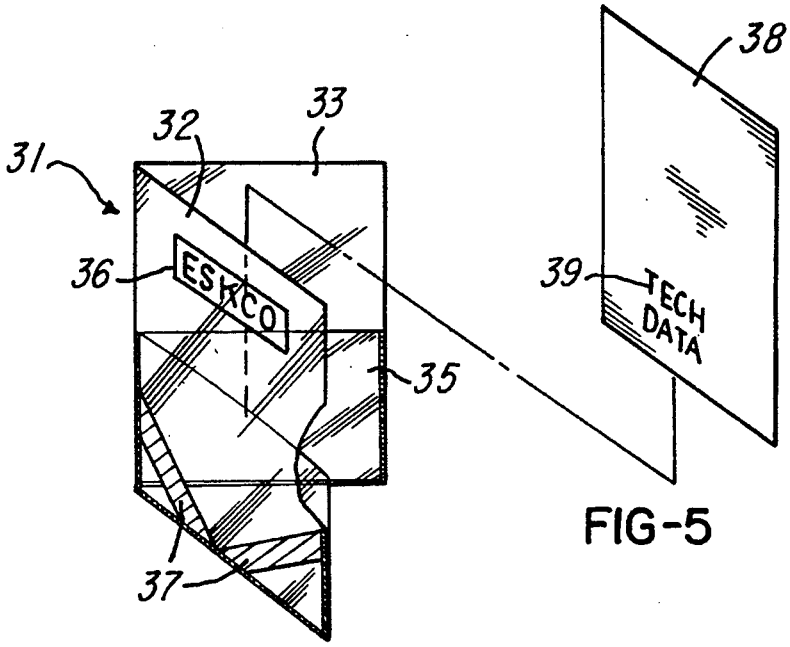
FIG. 5 is an exploded perspective view of another embodiment of the invention.

FIG. 5 illustrates the folder 31, consisting of a front sheet 32 and a back sheet 33. Pockets 34 and 35 extend for approximately the lower half of the sheets, and are heat sealed along the bottom and side edges. As in the FIGS. 1 and 2 embodiments the graphic information is applied to the front cover, this information consisting of the company name in a rectangular box, designated by reference number 36, and decorative stripes 37 which may be in color-in this instance shown as brown. An insert sheet 38, bearing information 39, is revealed through the front sheet 32. Although not shown, it is also possible to insert a similar sheet into the back sheet pocket 35 which may be viewed from the outside of the back sheet 33.

Figure 6:
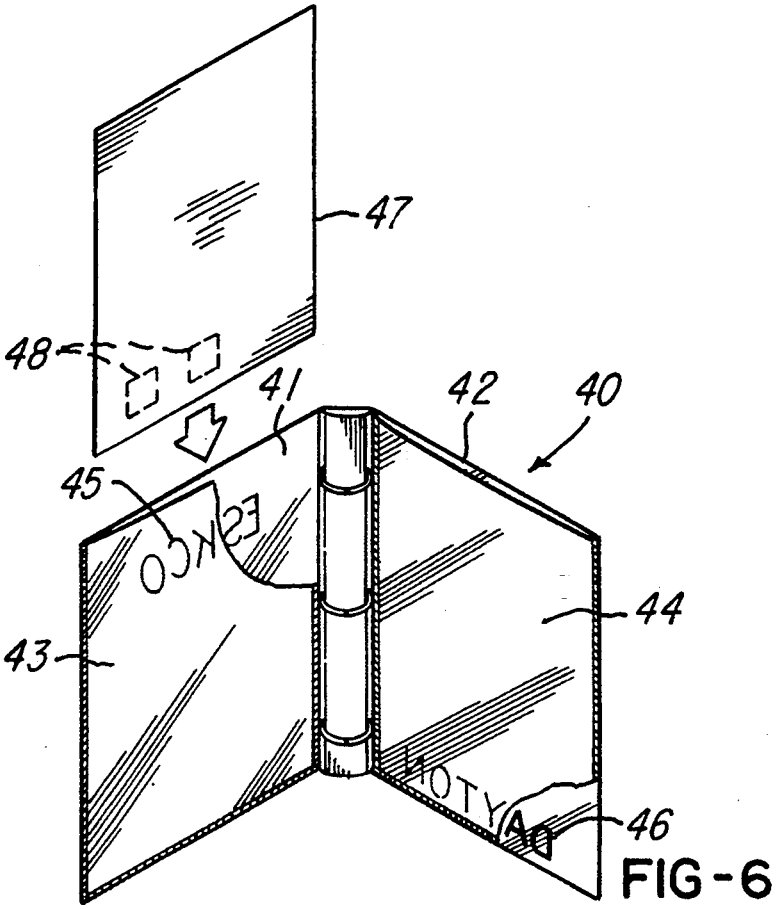
FIG. 6 is an exploded perspective view of still another embodiment of the invention.

FIG. 6 illustrates a variation of the folder concept of FIG. 5, applying the graphics to a front and rear transparent cover of a three ring binder 40. The cover sheets 41 and 42 are shown in this instance as having full length pockets 43 and 44 heat sealed to the cover sheets. The binder is viewed from the inside and the graphics in this instance are applied to either the outer or inner surface of the front cover sheet 41, and to the back cover sheet 42, portions of the pockets 43 and 44 shown broken away for clarity. The graphic 45 is the company name on the front sheet and graphic 46 is additional information on the back sheet. An information sheet 47, bearing desired information 48, is inserted into the front pocket 43 so that the information 48 is revealed through the front cover. If desired, a similar information sheet may be inserted into the back pocket.

Figure 7:
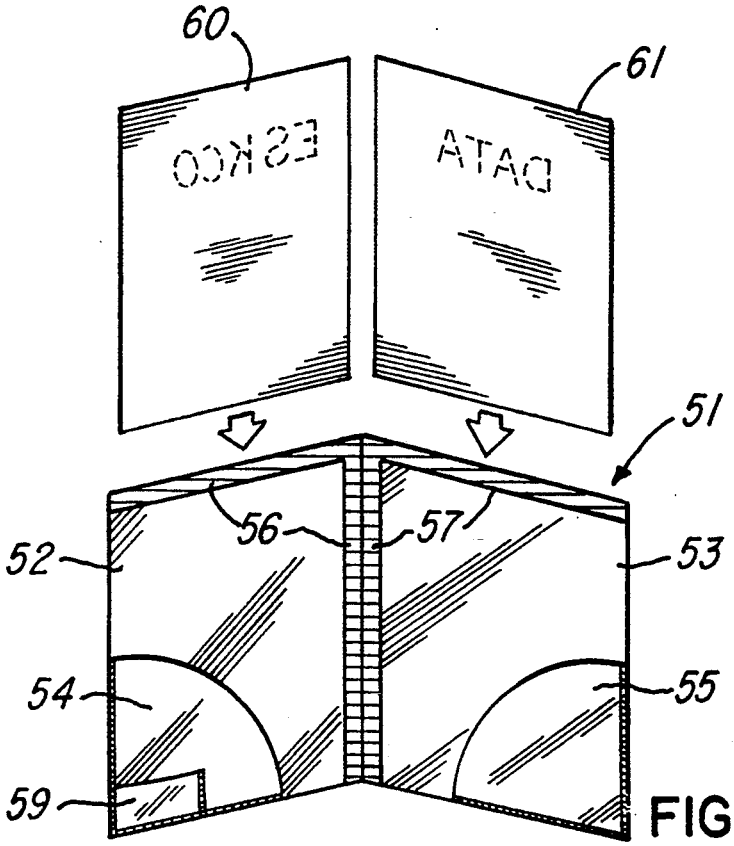
FIG. 7 is also an exploded perspective view of a further embodiment of the invention.

FIG. 7 is an inside view of a further embodiment in which the folder 51 consists of front and back cover sheets 52 and 53 having partial pockets 54 and 55 for retaining inserts. In this embodiment, the graphics 56 and 57 are in the form of a broad stripe 58 along the upper and inner edges, in this instance shown as blue. As an optional feature, a pocket 59 for holding business cards may be secured to the pocket 54. Information sheets 60 and 61 containing desired data, are inserted within the pockets 54 and 55 so that the data is revealed through the transparent areas of the cover sheets.

It should be understood that the above embodiments illustrate features that are fully interchangeable. The graphics shown are merely illustrative, and may include any desired patterns of stripes, geometric figures, company logotypes, or any desired wording, and may be in any desired combinations of these shapes and colors. Other modifications may be made within the spirit of the invention.

We claim:

1. A combination of a presentation folder and at least one information sheet placed therein comprising a folder comprising a transparent or translucent plastic cover sheet having a predetermined dimensions and having pocket means attached thereto for retaining and protecting the at least one information sheet, said cover sheet having graphics applied to selected areas on a surface thereof, said applied graphics causing only said selected areas being opaque while the remaining areas of the surface of said cover sheet being transparent or translucent, said information sheet having substantially the same predetermined dimensions as of said cover sheet and being adapted for repeated insertion into and removal from said pocket means and having information indicia printed thereon, said transparent or translucent areas of said cover sheet revealing all of said information indicia therethrough, said graphics on said cover sheet and said information indicia on said information sheet being simultaneously visible to provide visual correlation between said graphics and said information indicia being displayed through said transparent or translucent areas of said cover sheet, said correlation jointly creating a harmonious design and a customizing effect to said combination when said information sheet is inserted in said pocket means of said folder.

2. The folder of claim 1 wherein said graphics are in the form of a pre-selected pattern.

3. The folder of claim 1 wherein said graphics form at least one designation.

4. The combination of claim 1 wherein said graphics are applied by printing.

5. The combination of claim 1 wherein said graphics are applied by silk screening.

6. The combination of claim 1 whereby said graphics are applied by hot stamping.

7. The combination of claim 1 whereby said graphics are applied by appliquéing.

8. The combination of claim 1 wherein said graphics are in the form of decorative markings.

9. The combination of claim 8 wherein said decorative markings are placed along the entire periphery of said cover sheet.

10. The combination of claim 8 wherein said decorative markings are in the form of stripes.

11. The combination of claim 8 wherein said graphics are in the form of a block and said printed information indicia is displayed within said block.

12. The combination of claim 1 wherein said folder comprises front and rear cover sheets and said graphics are applied to both of said cover sheets.

13. The combination of claim 12 wherein a first information sheet having data printed is inserted behind said front cover sheet to display its data printed therethrough, and a second information sheet having separate data is inserted behind said rear cover sheet to display its data therethrough.

14. The combination of claim 12 wherein the graphics are decorative markings.

15. The combination of claim 12 wherein at least one of said cover sheets includes an additional transparent or translucent pocket for displaying additional information.

16. The combination of claim 1 wherein said graphics comprise at least one designation.

17. A method of making a combination of a presentation folder and at least one information sheet placed therein, comprising forming at least one transparent or translucent plastic cover sheet having a predetermined dimensions, applying graphics to selected areas on a surface of said cover sheet, said applied graphics causing only said selected areas being opaque while retaining the remaining areas in transparent or translucent condition, providing an information sheet having substantially the same predetermined dimensions as of said cover sheet and printed information indicia on selected portions thereof, attaching pocket means on said cover sheet for permitting said information sheet to be repeatedly inserted into and removed from said pocket means, inserting said information sheet into said pocket means of said folder causing said printed information indicia on said selected portions being displayed through said transparent or translucent areas only when said information sheet is inserted into said pocket of said folder, thereby providing simultaneous visibility of said graphics and said printed information indicia to provide a visual correlation therebetween and jointly create a harmonious design and a customized effect to said folder.

18. The method of claim 17 wherein said step of applying graphics is selected from the group consisting of printing, silk screening, hot stamping or appliquéing.

19. The method of claim 17 wherein said graphics are decorative markings.

20. The method of claim 17 wherein said graphics are designations.

* * * * *